US011220878B1

(12) United States Patent
Sage

(10) Patent No.: US 11,220,878 B1
(45) Date of Patent: Jan. 11, 2022

(54) MECHANICALLY ACTIVATED SYSTEM AND METHOD OF DEPLOYING FRAC BALLS IN A WELLHEAD CONNECTION

(71) Applicant: John Sage, Carnegie, OK (US)

(72) Inventor: John Sage, Carnegie, OK (US)

( * ) Notice: Subject to any disclaimer, the term of this patent is extended or adjusted under 35 U.S.C. 154(b) by 188 days.

(21) Appl. No.: 16/502,014

(22) Filed: Jul. 2, 2019

Related U.S. Application Data

(60) Provisional application No. 62/831,370, filed on Apr. 9, 2019.

(51) Int. Cl.
*E21B 33/068* (2006.01)
*E21B 43/26* (2006.01)
*E21B 34/14* (2006.01)

(52) U.S. Cl.
CPC ..... *E21B 33/068* (2013.01); *E21B 34/142* (2020.05); *E21B 43/26* (2013.01); *E21B 43/2607* (2020.05)

(58) Field of Classification Search
CPC .... E21B 33/068; E21B 43/26; E21B 43/2607; E21B 34/142; E21B 34/10; E21B 2200/04
See application file for complete search history.

(56) References Cited

U.S. PATENT DOCUMENTS

2011/0232923 A1* 9/2011 Barbee ..... E21B 33/16 166/386
2012/0152525 A1* 6/2012 McGuire ..... E21B 41/00 166/193
2020/0056440 A1* 2/2020 Golinowski ..... E21B 43/26

* cited by examiner

*Primary Examiner* — Yong-Suk (Philip) Ro
(74) *Attorney, Agent, or Firm* — Michael Diaz

(57) ABSTRACT

An apparatus for dispensing frac balls into a wellhead includes an outer sleeve, an inner sleeve positioned and moveable within an interior of the main body and a ball retention device for retaining a frac ball within an interior of the inner sleeve. A retained frac ball held in the ball retention device is released within the inner sleeve when weight or pressure is applied to the inner sleeve to cause the inner sleeve to slide upwardly within the main sleeve.

13 Claims, 13 Drawing Sheets

MECHANICALLY ACTIVATED SYSTEM AND METHOD OF DEPLOYING FRAC BALLS IN A WELLHEAD CONNECTION

RELATED APPLICATIONS

This utility application claims the benefit of U.S. Provisional Patent Application Ser. No. 62/831,370 filed Apr. 9, 2019 by John Sage, which is hereby incorporated by reference.

BACKGROUND OF THE INVENTION

Field of the Invention

The invention relates to oil and gas system and methods, Specifically, and not by way of limitation, the present invention relates to a system and method of deploying frac balls using a force or weight activated mechanism.

Description of the Related Art

Fracking, which is also known as hydraulic fracturing, is a method of artificially stimulating oil and gas wells by using pressurized water or other fluids forced into boreholes and finally into fossil fuel reservoirs. This forced pressurized fluid "fractures" rock formations, which assist in retrieving more hydrocarbon resources to the surface, During the fracking process, a fluid mixture, usually consisting of water, sand and other chemical additives is pumped under high pressure into the shale formation to create small fractures. The mixture is mostly water and sand with a very small percentage of special-purpose additives. These fractures are then "propped" open by the sand, which allows the natural gas or other hydrocarbons to flow into the well bore where it is subsequently collected at the surface, One important tool used by fracking operators oftentimes includes specially sized "frac balls" These frac balls are injected into a well bore and utilized to block or close off portions of a well, thereby allowing pressure to build up and cause fracturing in a targeted section of the welt Frac balls are sized to fit in a specific well-bore or sliding sleeves inserted in the well-bore. These well bores and sliding sleeves may vary in diameter as the well sections progress from upper to lower (or end) sections.

Normal operations consist of a crane operator picking up the lubricator and new gun string. The operator then lowers the lubricator, with guns inside onto the rig lock system or automatic locking system (or equivalent). The lubricator is locked into place and gun string pumped down the hole for perforation. Once the guns have fired, the wireline contractor comes back to the surface with the spent gun string, Once at the surface, the crane operator picks up the lubricator and positions it so a new gun string can be run again. Once the crane is out of the way, personnel drop frac ball using various devices and procedures, such as a manlifts, fish nets, light bulb changers, high pressure fluids, or other means. It would be advantageous to have an apparatus which efficiently dispensed frac balls when the lubricator is removed from the wellhead. It is an object of the present invention to provide such an apparatus.

It would also be advantageous to have a system and method of inserting the frac balls without requiring personnel to get close to the treatment lines or frachead or requiring costly device set-ups for the insertion of these frac balls, it is an object of the present invention to provide such a system and method.

SUMMARY OF THE INVENTION

In one aspect, the present invention is an apparatus for deploying frac balls into a wellhead connection. The apparatus includes an outer sleeve, an inner sleeve positioned and moveable within an interior of the main body and a ball retention device for retaining a frac ball within an interior of the inner sleeve, A retained frac ball held in the ball retention device is released within the inner sleeve when weight or pressure is applied to the inner sleeve to cause the inner sleeve to slide upwardly within the main sleeve.

In another aspect, the present invention is directed to a method of deploying frac balls into an open well bore. The method begins by affixing a frac ball dispenser to a lubricator. Next, a frac ball is retaining within the frac ball dispenser. A frac ball retaining device is then mechanically actuated to release a frac ball retained in the frac ball dispenser and the frac ball is dispensed from a bottom of the frac ball dispenser into an open well bore.

DESCRIPTION OF THE INVENTION

Figure 1:
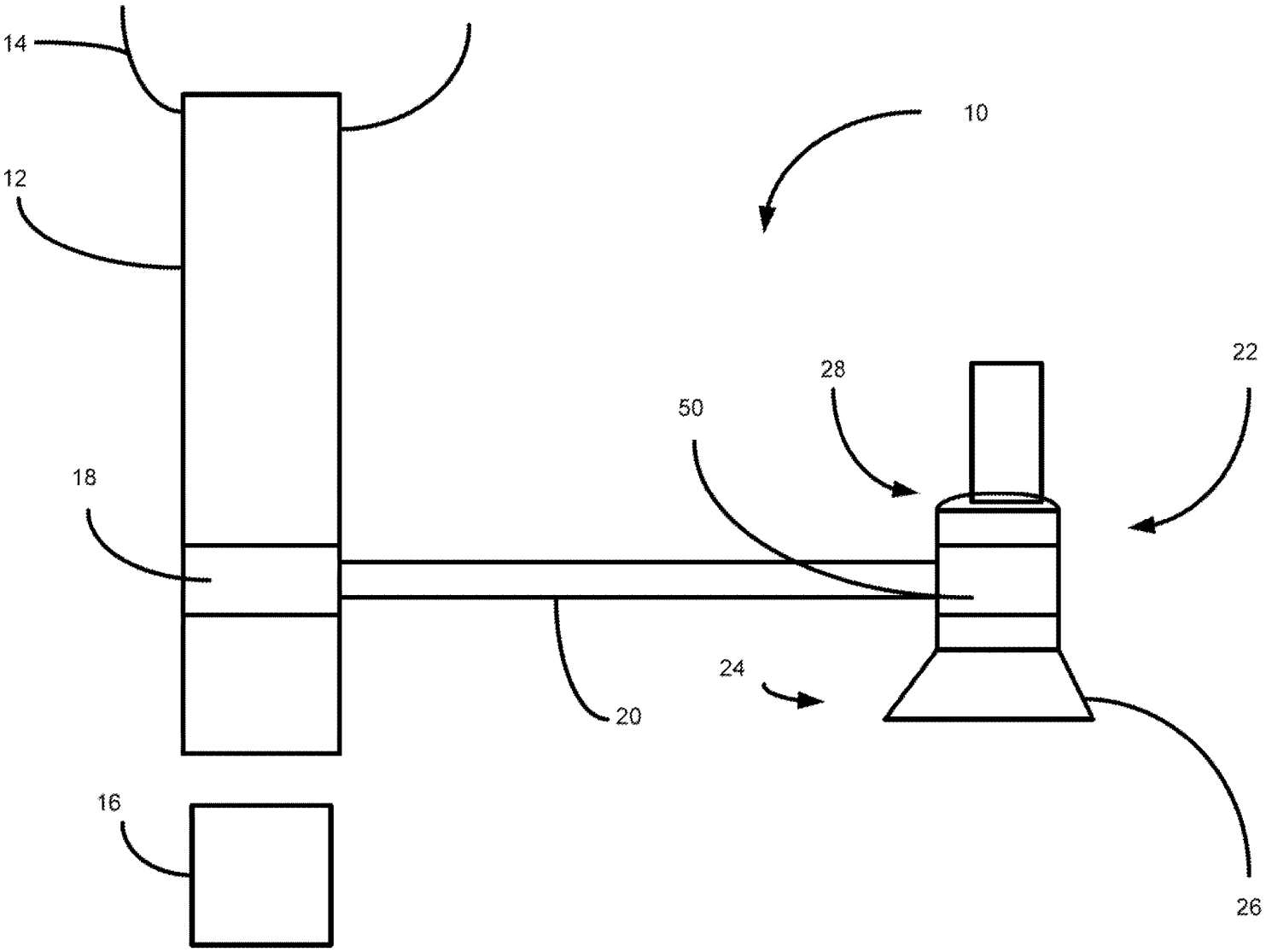
FIG. 1 is a simplified block diagram of the components utilized in a frac ball dispensing system in a first embodiment of the present invention.

The present invention is a system and method of utilizing a pressure or weight activated mechanism for deploying frac balls into a wellhead connection. The mechanism is force or weight activated by a wireline lubricator that is attached to a crane. FIG. 1 is a simplified block diagram of the components utilized in a frac ball dispensing system 10 in a first embodiment of the present invention. FIG. 1 is a side view illustrating a lubricator 12 lifted by a crane lift 14 over a wellhead 16. A fastening mechanism 18 connects an extension mount 20 to a mechanical frac ball dispenser 22 at an attachment point 50. The frac ball dispenser 22 includes a lower end 24 having a cone 26 and an upper end 28 having an optional hopper (not shown) for storing a plurality of frac balls 32. Typically, a crane operator lowers the lubricator 12 over the wellhead 16. After completing the necessary operations by the lubricator, the lubricator is lifted off the well head and the mechanical frac ball dispenser 22 is lowered over the wellhead 16.

Figure 2:
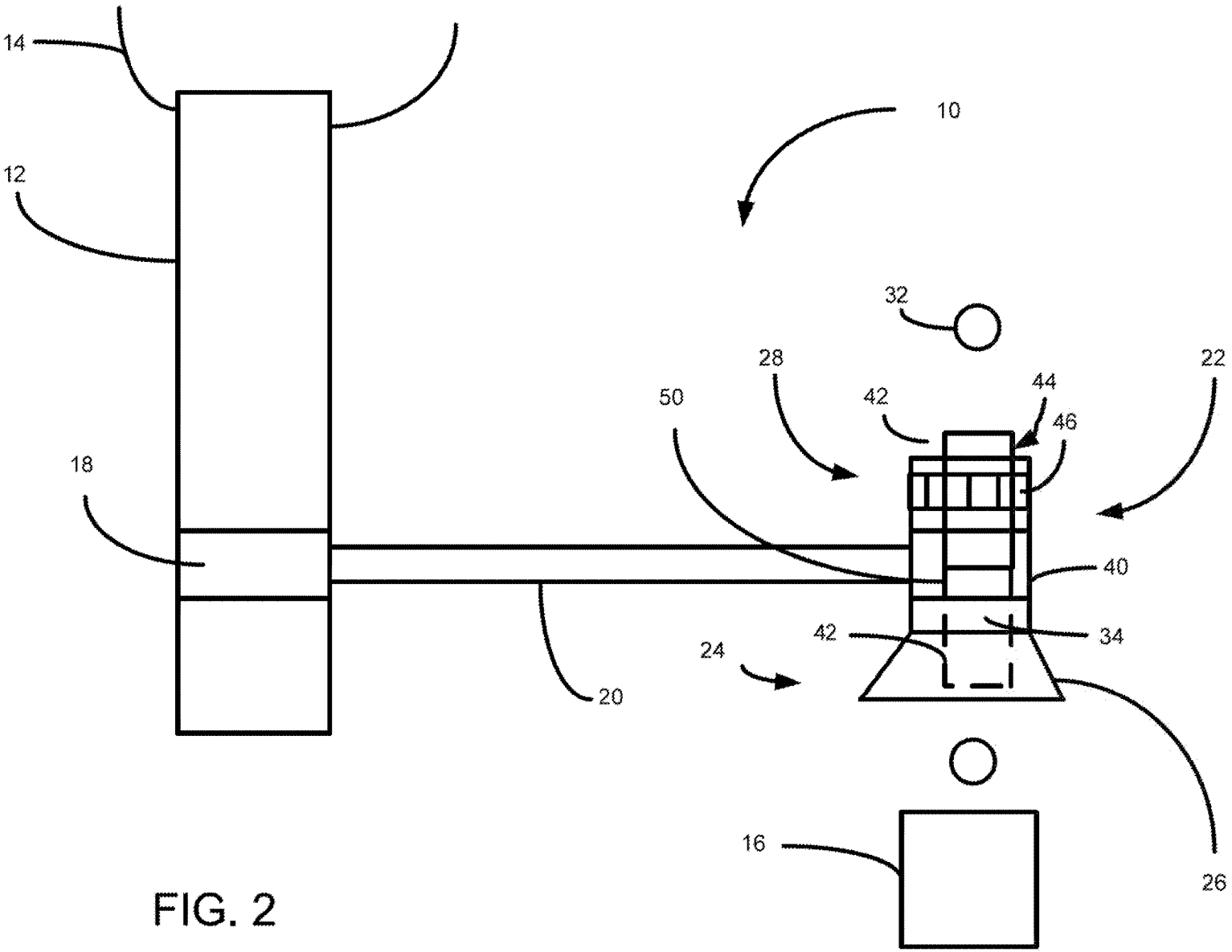
FIG. 2 illustrates a side view of the frac ball dispenser of FIG. 1 in the first embodiment of the frac ball dispensing system.
Figure 3:
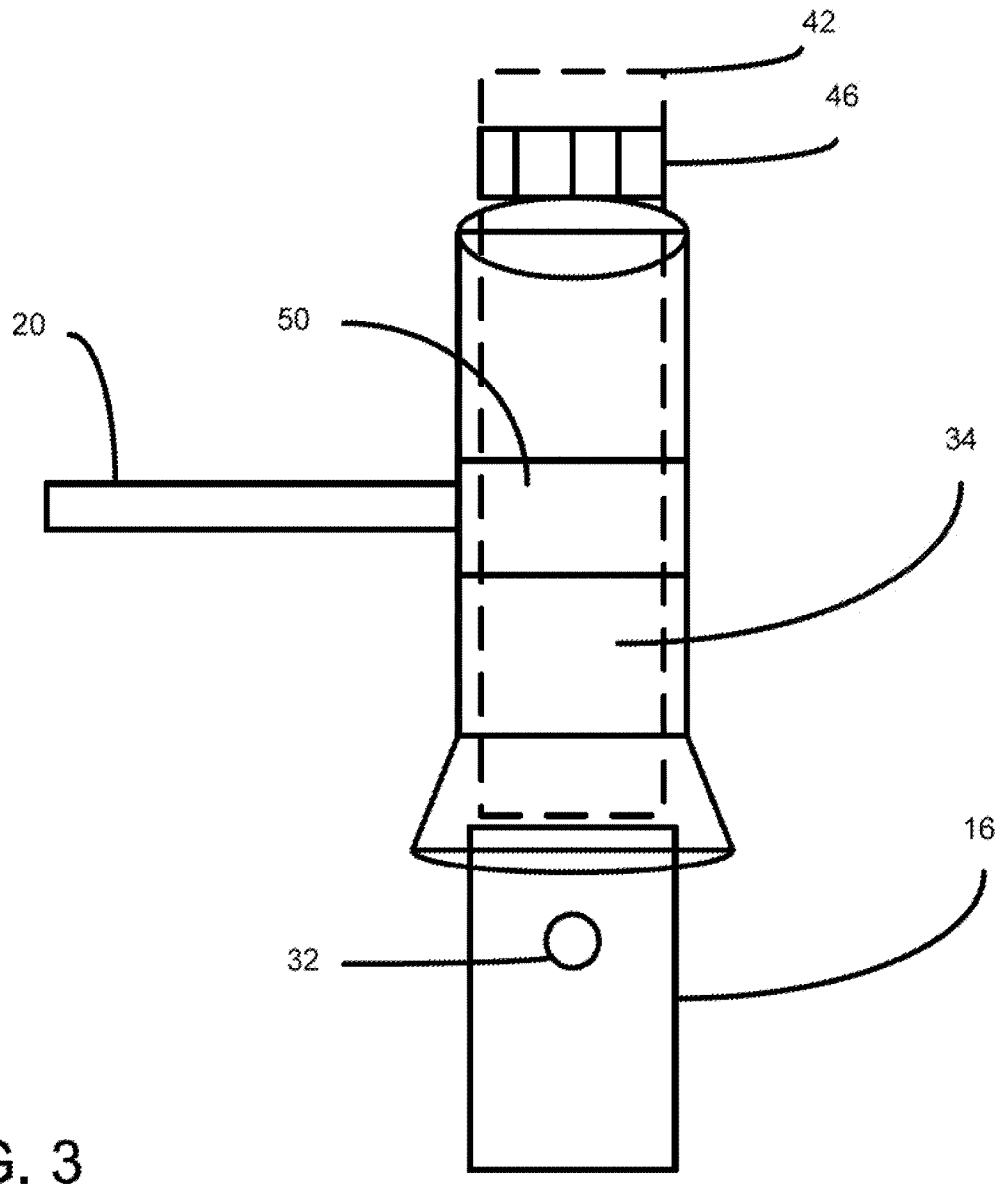
FIG. 3 illustrates an enlarged side view of the frac ball dispensing releasing a frac ball in the first embodiment of FIG. 1.

FIG. 2 illustrates a side view of the frac ball dispenser 22 over the wellhead 16 in the first embodiment of the frac ball dispensing system 10. FIG. 3 illustrates an enlarged side view of the frac ball dispensing releasing a frac ball in the first embodiment of FIG. 1. The cone 26 is positioned over the wellhead 16, often referred to as a "stump". The cone is sized and shaped to fit over the stump or wellhead 16. The cone extends into an elongated main body 40. The cone and elongated main body 40 are hollow and sized and shaped to contain a small diameter inner tube 42 capable of sliding up and down within the main body 40. As the frac ball dispenser 22 is lowered onto the stump, the inner tube, which is positioned within the elongated main body, is pushed upward. As the inner tube is pushed upward, the inner tube raises in such as fashion that a frac ball 32 is released by an interior ball retaining mechanism 34 through the inner tube and out through the lower end 24 into the wellhead 16. The act of dispensing the ball into the wellhead is enacted by mechanical energy, specifically force being applied to the inner tube 42 upward. When the inner tube raises out of the elongated main body a sufficient distance to enable the ball to be released from the ball retaining device 34, an outer surface 44 of the inner tube 42 shows a confirmation zone 46 which is marked differently than the rest of the outer surface. This provides a visual indication to the operator when the frac ball 32 is released from the frac ball dispenser 22. It should be understood that the inner tube 42 and the elongated main body 40 may be embodied in any shape and size (e.g., rectangular, octagonal, etc.) and still remain in the scope of the present invention.

Figure 4:
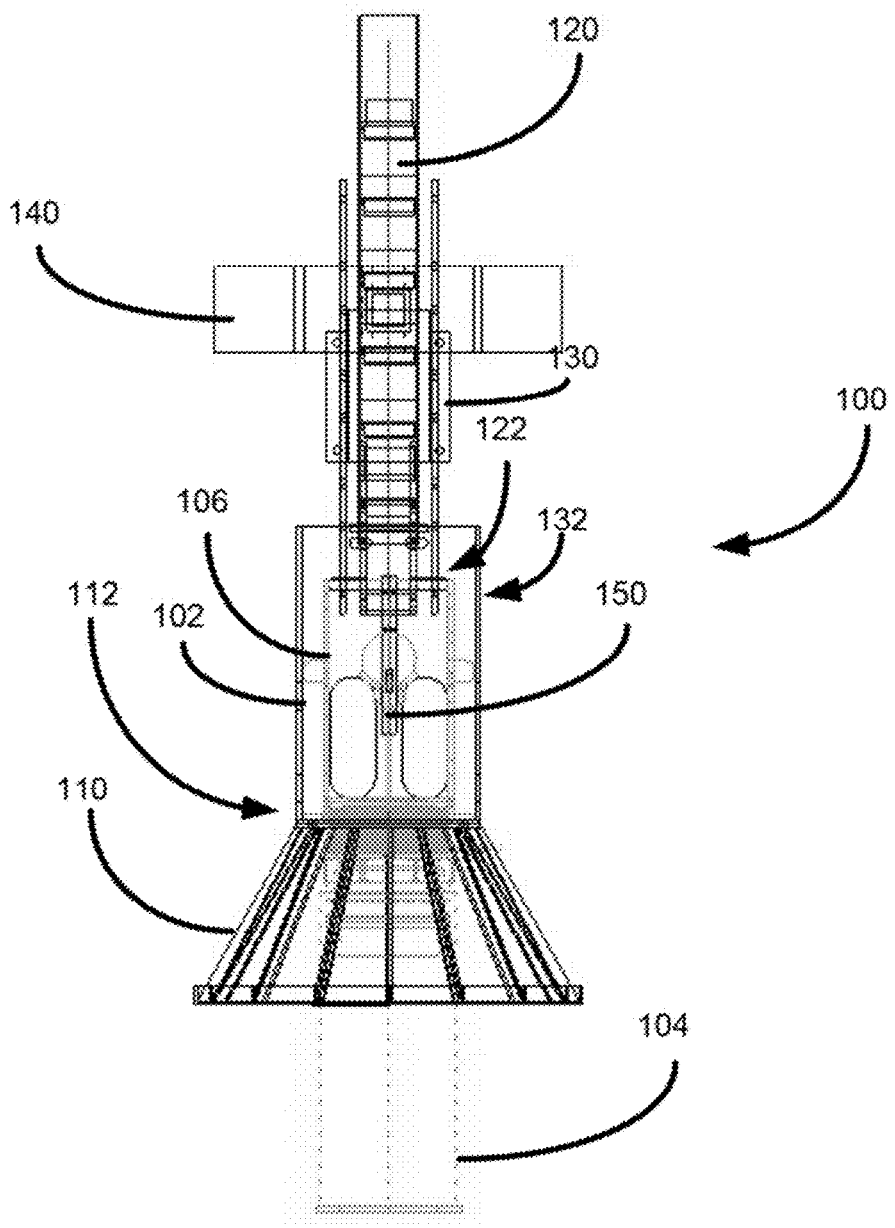
FIG. 4 is a front view of a frac ball dispenser in a second embodiment of the present invention.
Figure 5:
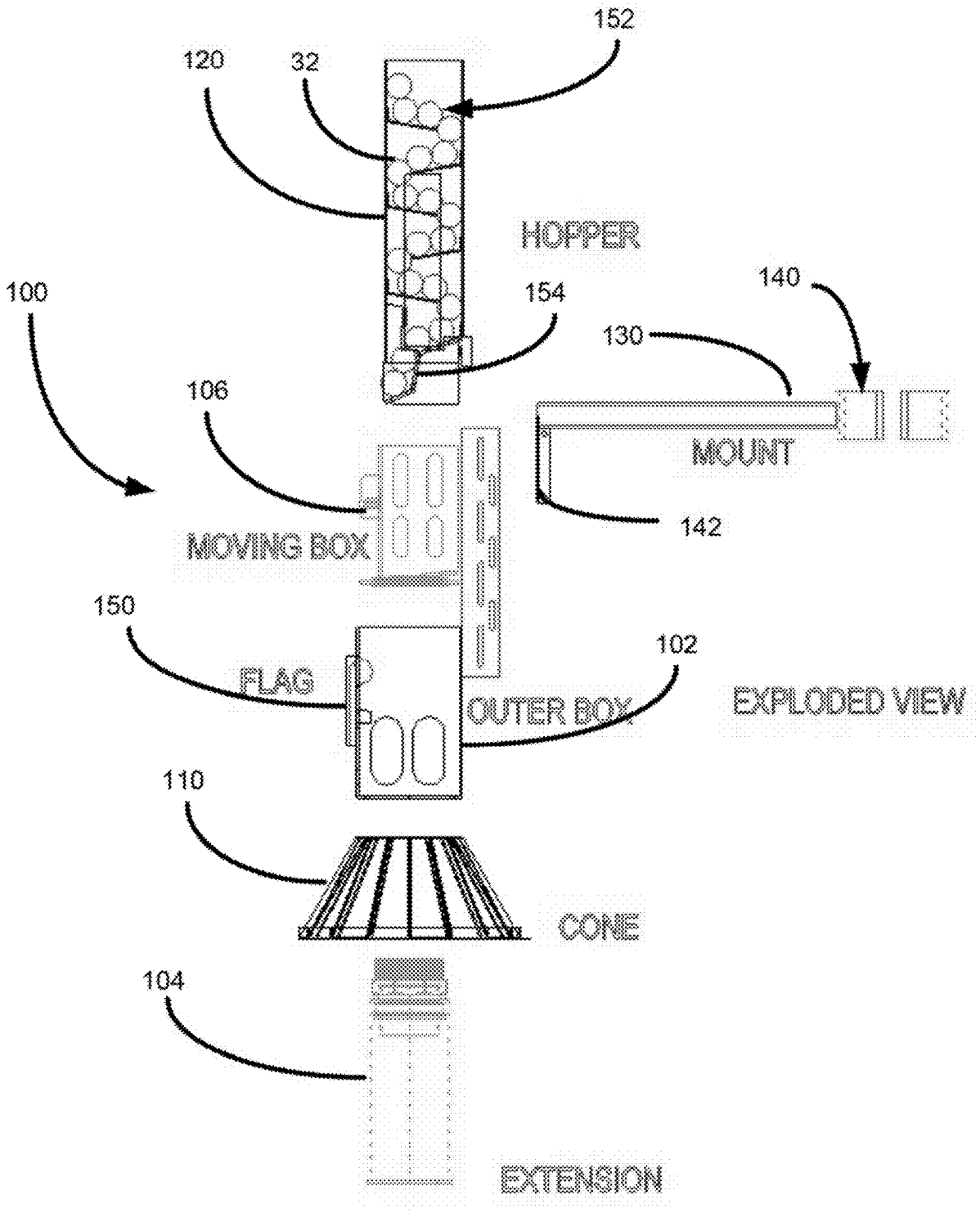
FIG. 5 is an exploded side view of the frac ball dispenser of FIG. 4.
Figure 6:
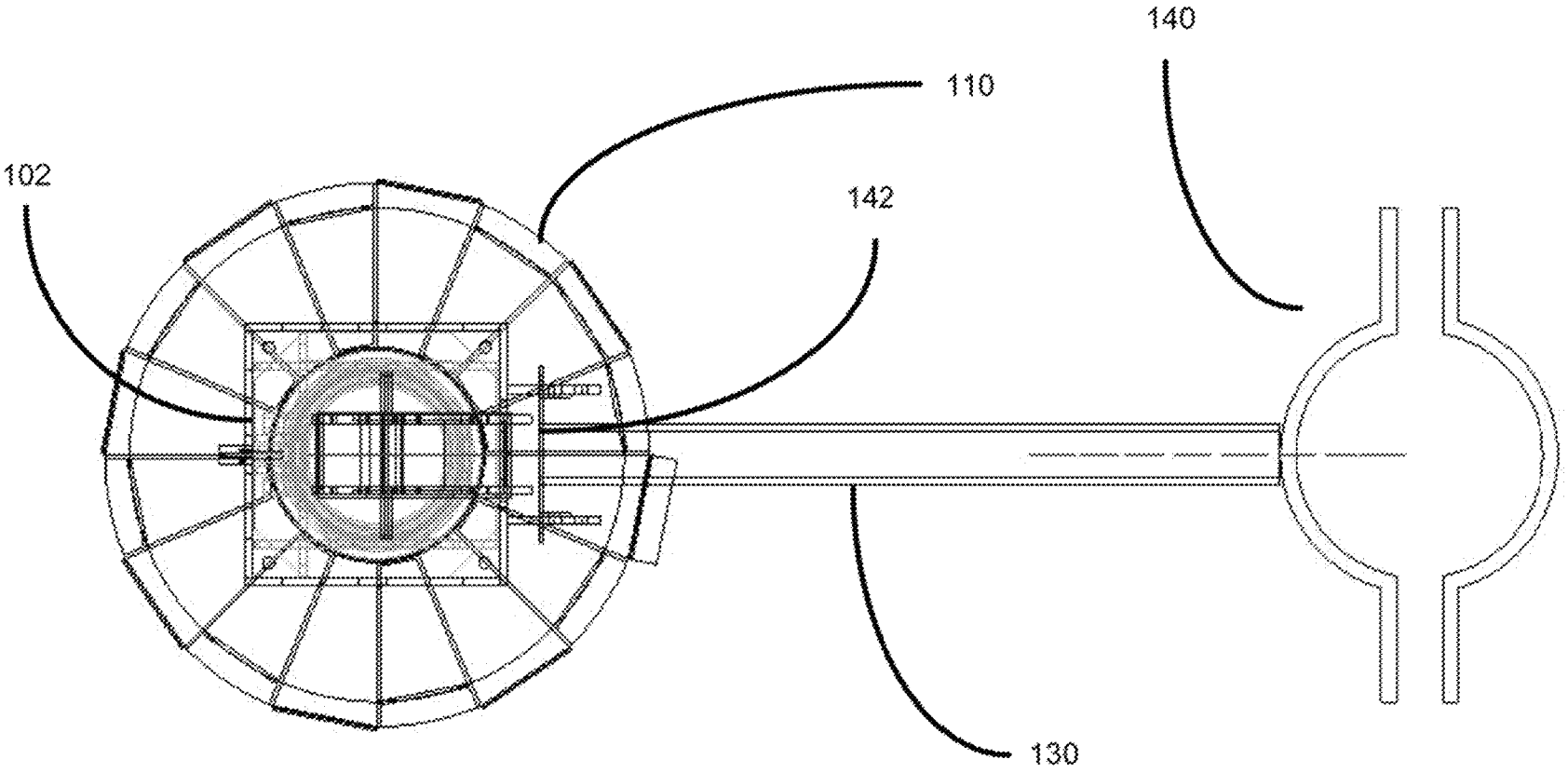
FIG. 6 is a top view of the frac ball dispenser of FIG. 4.

In addition, the present invention provides an apparatus to dispense frac balls using any type of mechanical energy actuated by applying the frac ball dispenser on the wellhead or upper portion attached on the wellhead. In a second embodiment, the frac ball dispenser may dispense the frac balls using gates and openings in the interior ball retaining mechanism 34. FIG. 4 is a front view of a frac ball dispenser 100 in a second embodiment of the present invention. FIG. 5 is an exploded side view of the frac ball dispenser 100 of FIG. 4. FIG. 6 is a top view of the frac ball dispenser 100 of FIG. 4. The frac ball dispenser includes a hollow outer box 102, an extension 104 affixed to a moving inner box 106. In this embodiment, the interior ball retaining mechanism includes the extension 104 and moving inner box 106 which are sized and shaped to move within the outer box 102. A cone 110 is affixed to a lower end 112 of the outer box 102. A hopper 120 containing a plurality of frac balls 32 is affixed to an upper end 122 of the moving box 106, A mount 130 is affixed to an outer surface 132 of the frac ball dispenser 100 on one end and affixed to a lubricator 12 (not shown) on an opposite end. The mount enables the frac ball dispenser 100 to be attached, at a fixed distance from the lubricator 12.

Figure 7:
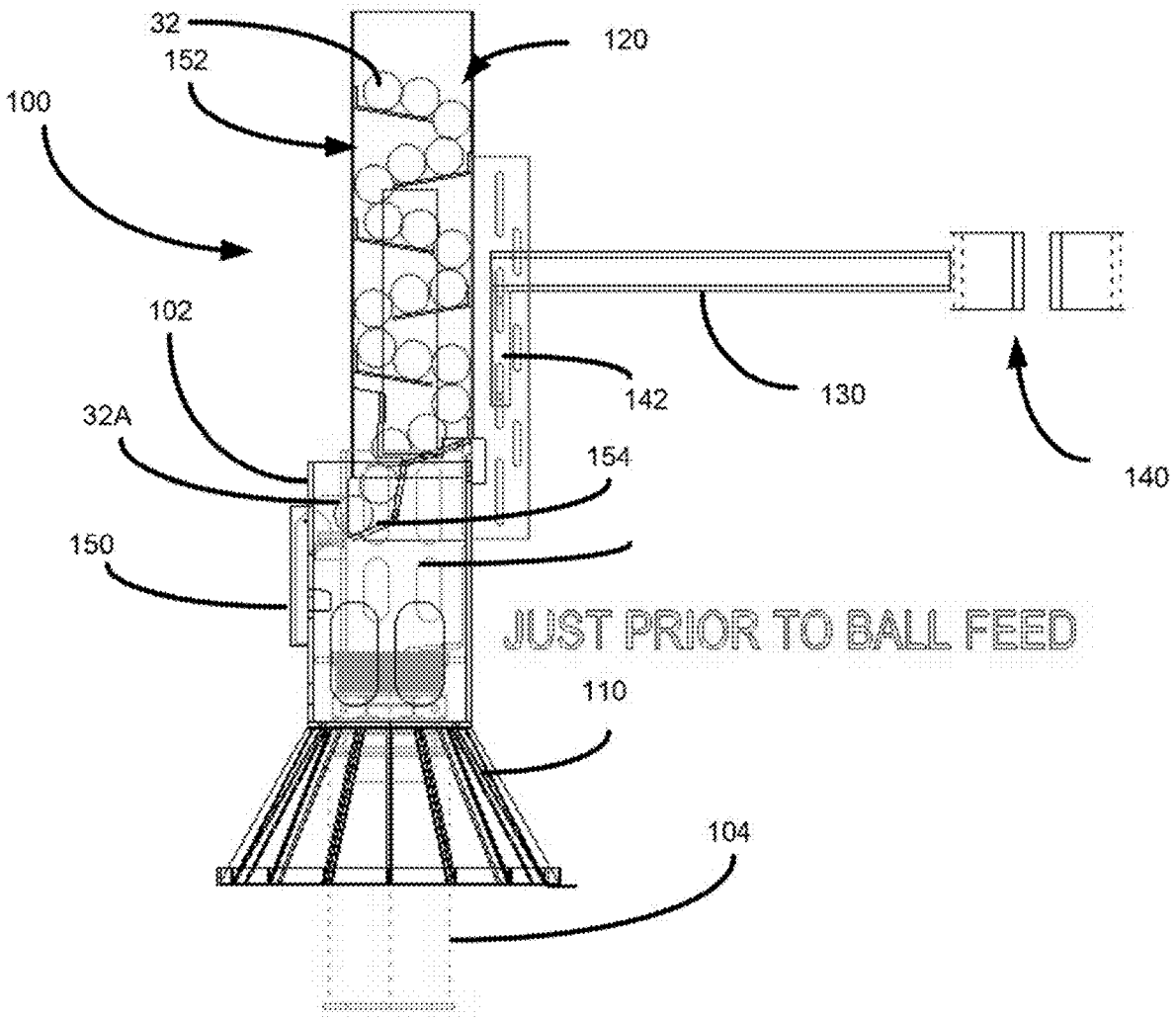
FIG. 7 illustrates the frac ball dispenser of FIG. 4 in a position just prior to the frac ball being fed to the inner box.
Figure 8:
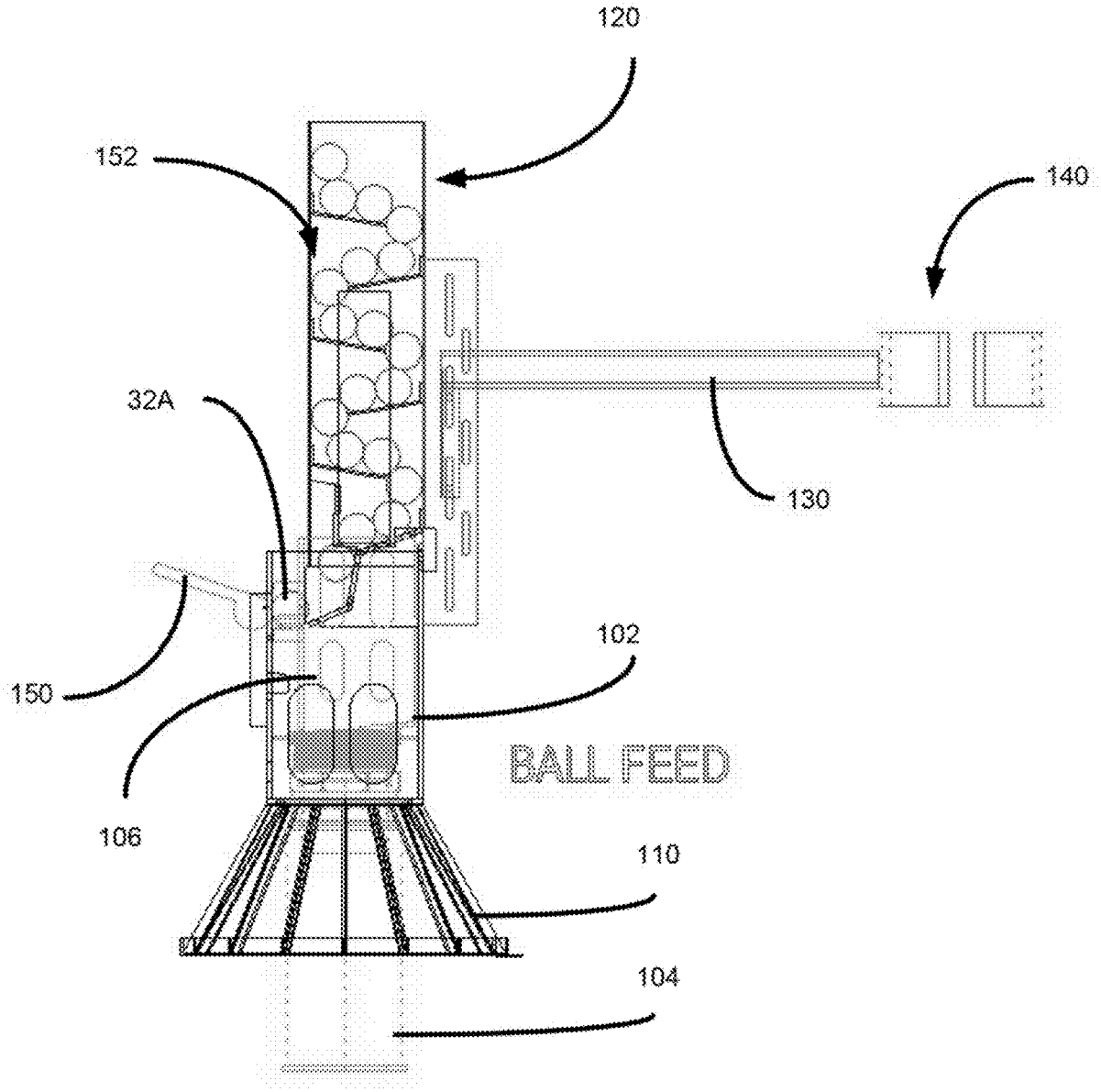
FIG. 8 illustrates the frac ball dispenser of FIG. 4 in a position where the frac ball is fed into the frac ball dispenser.

The mount 130 includes a fastening mechanism 140 for secure attachment to the lubricator 12, On an opposite side of the mount is an attachment point 142 to the frac ball dispenser 100. The mount enables the frac ball dispenser 100 to be firmly and securely fastened to the lubricator during movement of the lubricator. The frac ball dispenser also includes a flag 150 providing a visual indication when a ball has been dispensed. Additionally, the hopper for retaining a plurality of frac balls 32 may take various forms. In one embodiment, the frac balls are positioned in a diagonally downward aligned passageway 152 in single file line which are sequentially fed into the interior of the frac ball dispenser. At a bottom portion of the hopper is a pivoting gate 154 which prevents exit of the frac balls from the bottom of the hopper 120 into the interior of the frac ball dispenser, FIG. 7 illustrates the frac ball dispenser in a position just prior to the frac ball 32 being fed to the inner box 106. At this point in the operation, the frac ball dispenser 100 with the extension 104 is positioned over the wellhead 16 (not shown in FIG. 7), The pivoting gate 154 is in the up position. The plurality of frac balls lie within the passageway 152 of the hopper 120. Without the gate 154 in the up position, the frac balls would be gravity feed into the interior of the frac ball dispenser 100. The extension is at its lowest position as it is biased to the extended (down) position as shown in FIG. 7. The flag 150 is in the down position to indicate that the ball has yet to be fed into the inner box 106. As depicted in FIG. 7, the lead frac ball 32A lies on top of the gate 154, FIG. 8 illustrates the frac ball dispenser in a position where the frac ball 32A is fed into the frac ball dispenser 100. This position occurs when the operator positions the extension against the top of the wellhead 16. The extension is pushed up by the weight of the frac ball dispenser 100 laying on top of the wellhead 16 (not shown in FIG. 8), which in turn slides the inner box 106 upward. The frac ball 32A moves to a position adjacent the gate 154 wherein it is ready for dropping through the inner box 106. With the frac ball 32A positioned for feeding, the flag 150 is raised to the up position, providing a visual indication to the operator that of the frac ball feed position.

Figure 9:
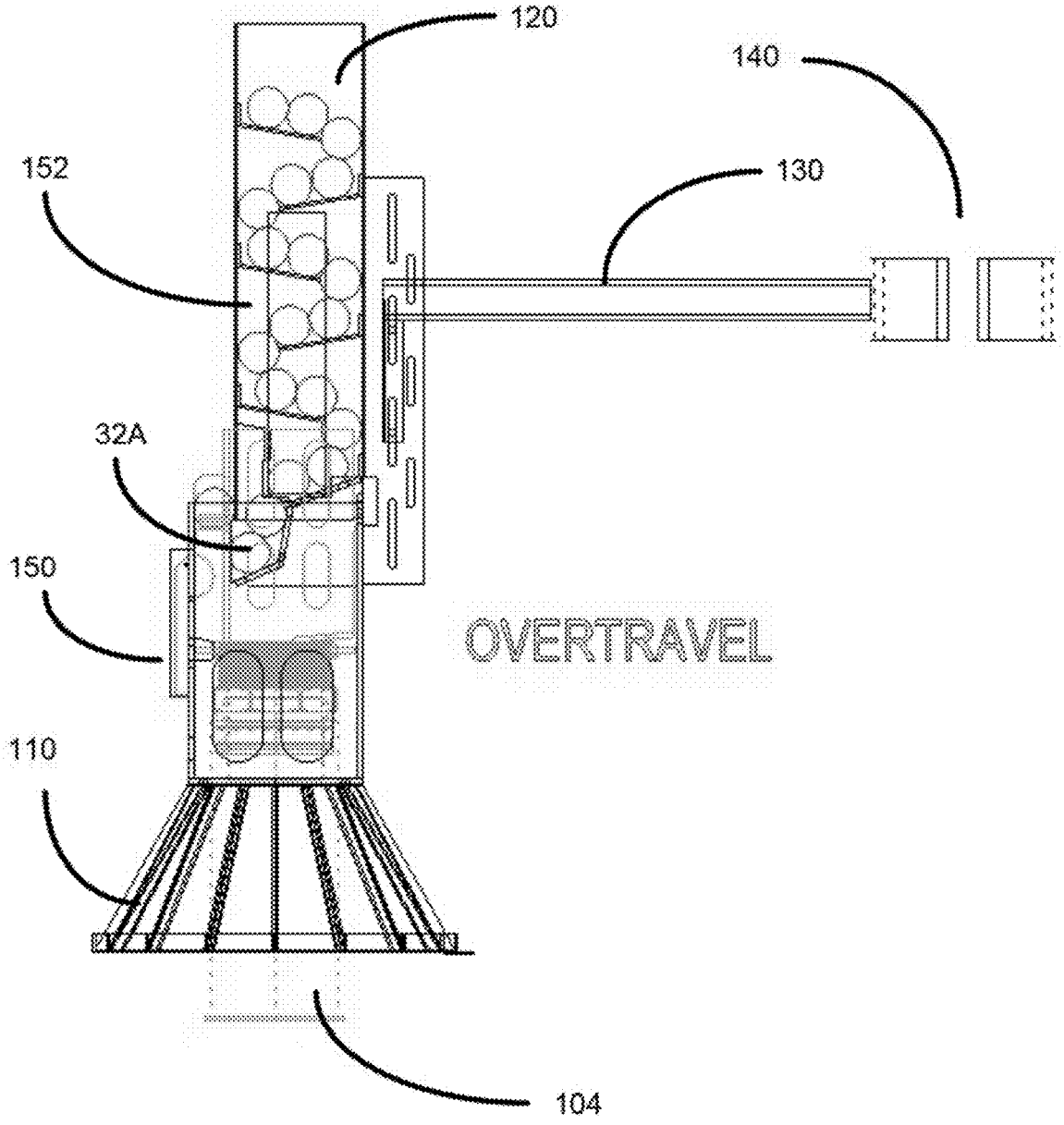
FIG. 9 illustrates the frac ball dispenser of FIG. 4 in an overtravel position of the frac ball.

FIG. 9 illustrates the overtravel position of the frac ball 32A. In this position, the frac ball 32A continues movement onto the top of the pivoting gate 154. The extension 104 and attached inner box 106 is in the up position because the extension still lies on top of the wellhead 16 (not shown in FIG. 9). Additionally, as the ball has been fed and the frac ball has moved to the overtravel position, the flag 150 automatically lowers.

Figure 10:
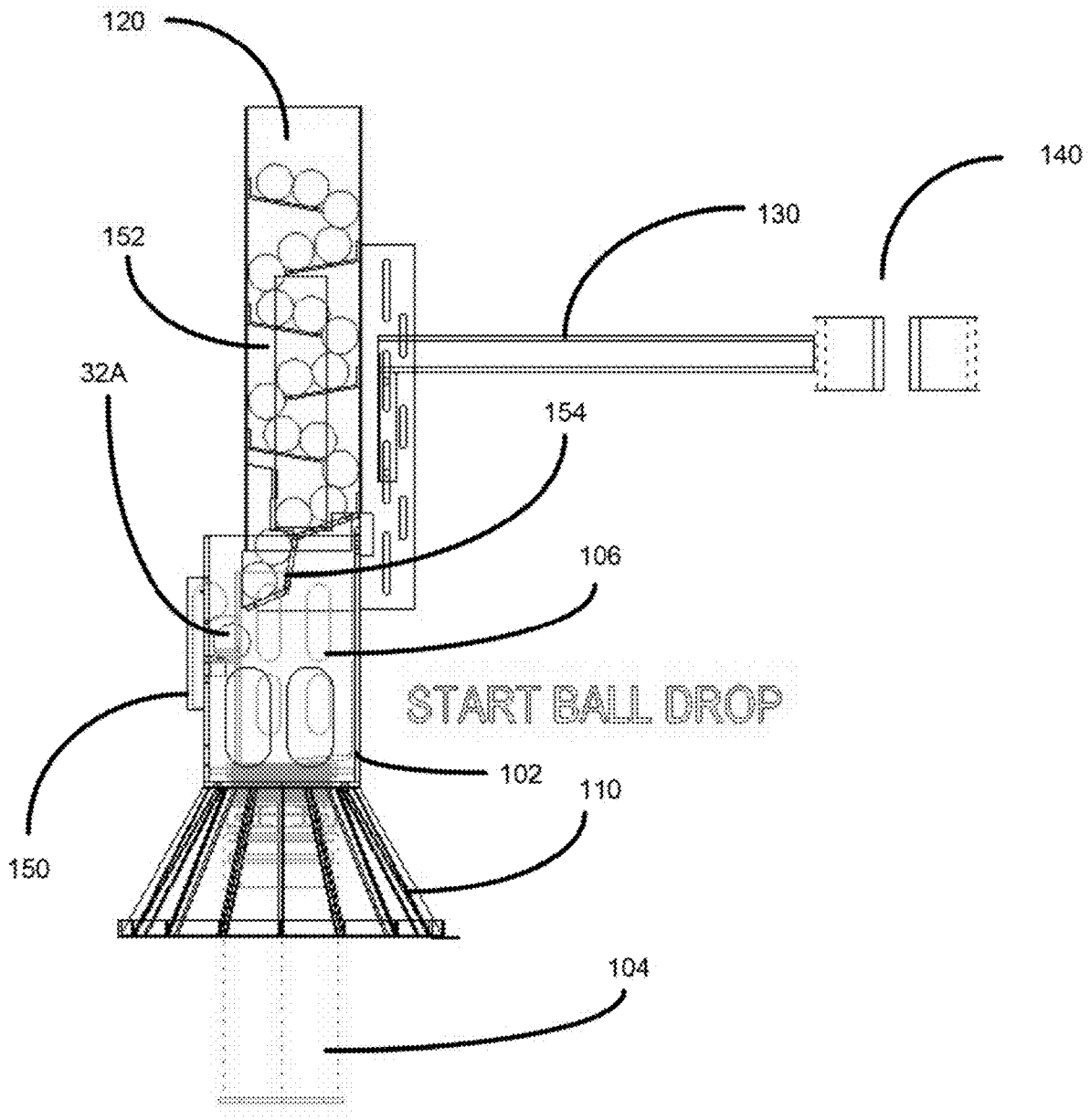
FIG. 10 illustrates the frac ball dispenser of FIG. 4 with the frac ball initially dropping via gravity through a pathway.
Figure 11:
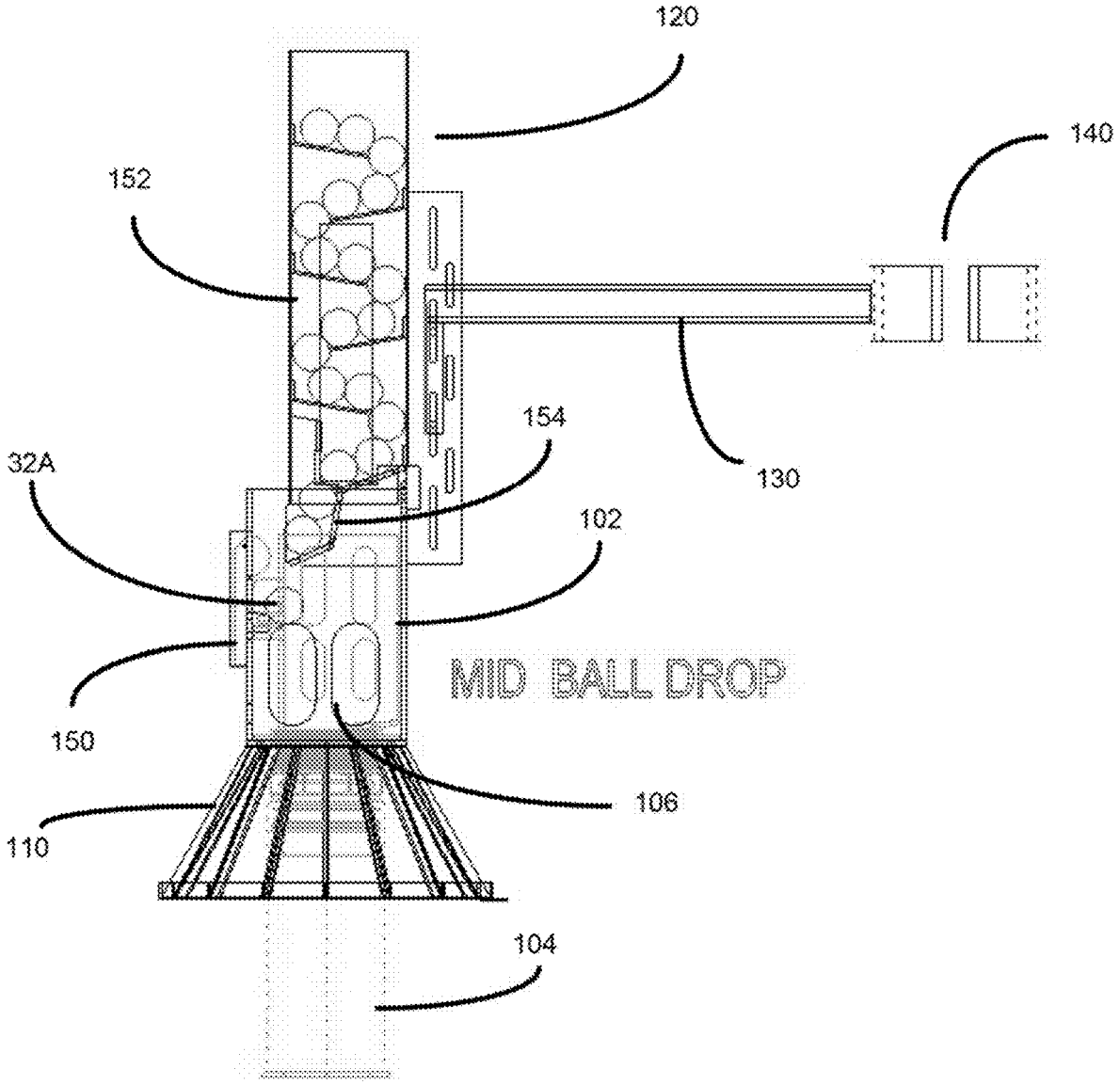
FIG. 11 illustrates the frac ball dispenser of FIG. 4 with the frac ball at mid-drop feed.
Figure 12:
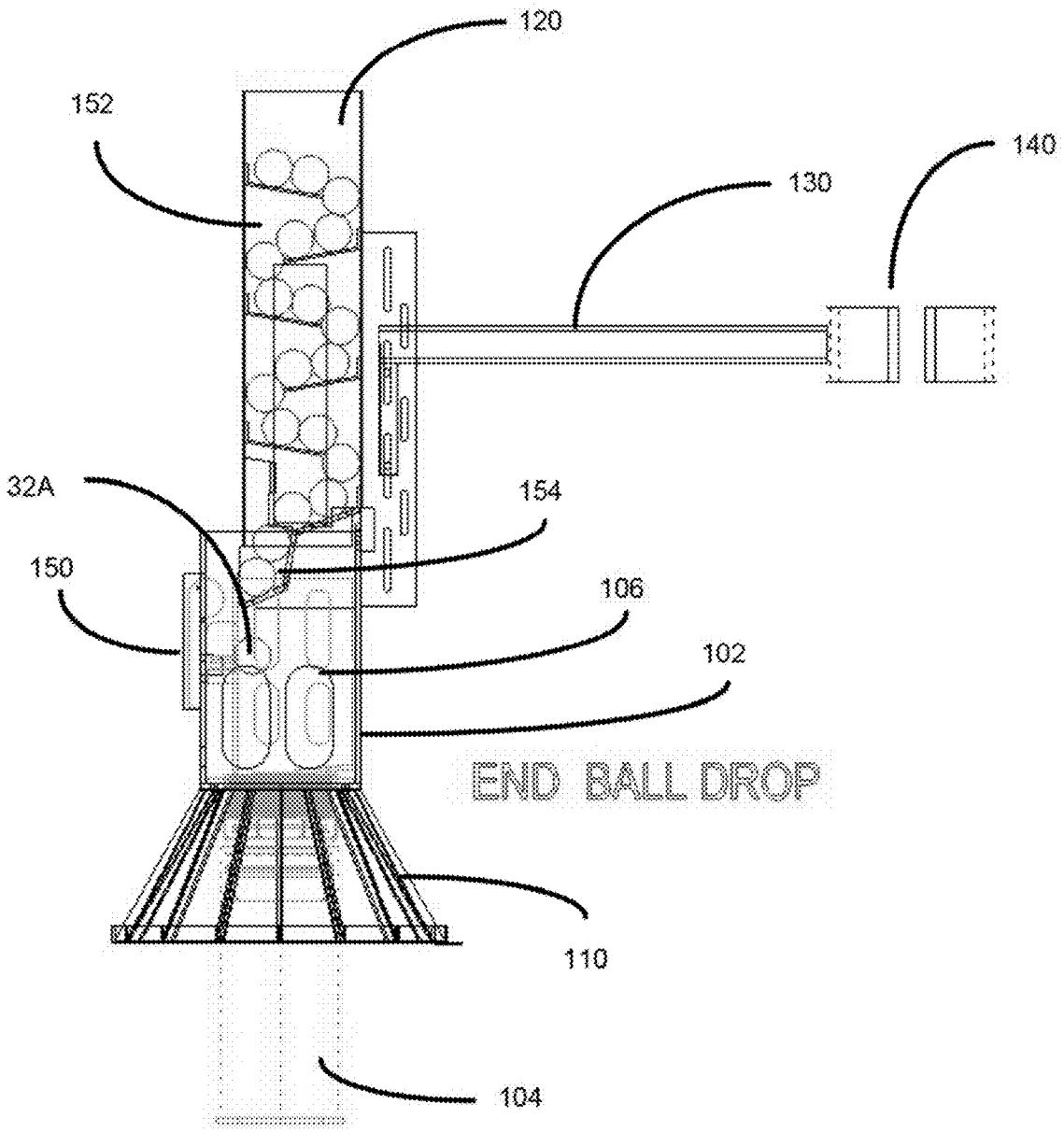
FIG. 12 illustrates the frac ball dispenser of FIG. 4 with the frac ball dropped into the interior of the inner box.

Once the frac ball 32A has been fed to the interior of the frac ball dispenser 100, the next steps enable the frac ball 32A to drop via gravity through the interior of the frac ball dispenser through passages leading to the bottom of the inner box and hollow extension 104, and finally into the wellhead, FIG. 10 illustrates the frac ball 32A initially dropping via gravity through a pathway (not shown in FIG. 10). FIG. 11 illustrates the frac ball 32A at mid-drop feed. FIG. 12 illustrates the frac ball 32A finally gravity drops into the interior of the inner box 106. Although not illustrated, at this point, the frac ball 32A falls down through the interior of the inner box 106 and extension 104 and into the wellhead 16.

Although the present invention is depicted with an outer box and an inner box, the inner and outer devices may take any shape or size. The present invention may be embodied in an mechanism which slides an inner sleeve with an outer sleeve to allow one or more frac balls to be retained and when force is applied on the lower end of the frac ball dispenser, for the frac ball to be mechanically actuated to enable a ball to be dropped into the wellhead 16. The present invention discloses the use of a main body or outer box which is an outer sleeve and an inner tube or inner box which acts as a slidable inner sleeve. As discussed above, the inner and outer sleeves may take any cross-sectional shape as well as any size which can accommodate frac balls. Additionally, although a flag is shown to provide a visual indicator of the frau ball being fed to the frac ball dispenser, the indicator is optional and may take any form to provide a visual indication to the operator. Once the frac ball is fed into the dispenser and dropped into the wellhead, the operator may remove the frac ball dispenser from the wellhead.

Figure 13:
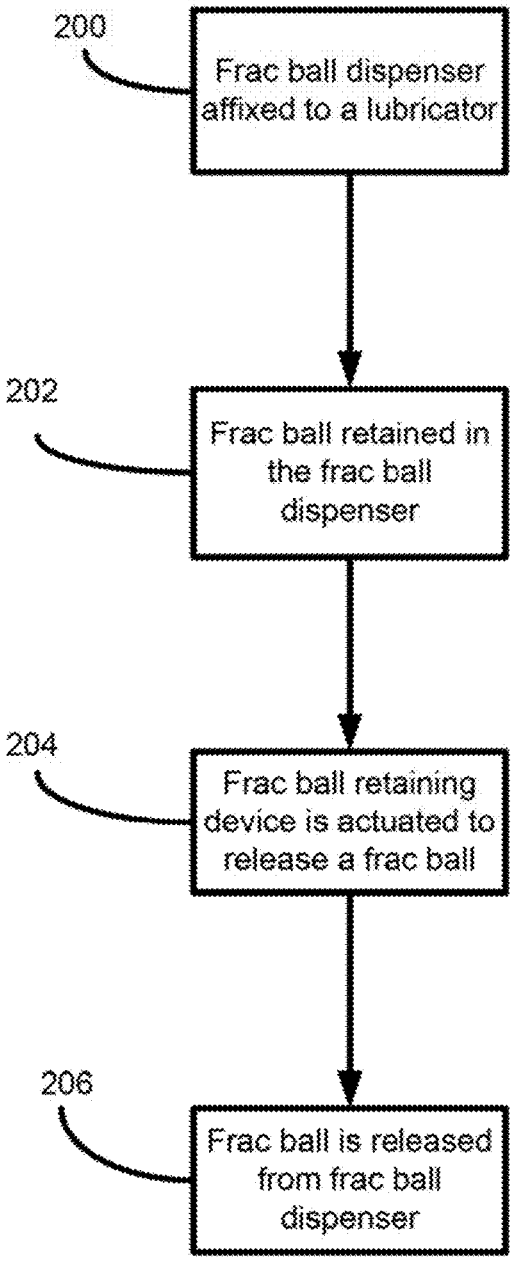
FIG. 13 is a flowchart illustrates the steps of a method of deploying frac balls into an open well bore.

FIG. 13 is a flowchart illustrates the steps of a method of deploying frac balls into an open well bore. The method begins with step 200 where a frac ball dispenser is affixed to a lubricator. Next, in step 202, a frac ball is retained in the frac ball dispenser. In step 204, a frac ball retaining device within the frac ball dispenser is mechanically actuated when the frac ball dispenser is positioned on top of the wellhead, thereby releasing a frac ball retained in the frac ball dispenser. Next, in step 206, the released frac ball is released (dropped) from a bottom of the frac ball dispenser into an open well bore.

The present invention provides many advantages over existing systems and methods for dispensing frac balls into a well bore. The present invention enables the safe and efficient insertion of frac balls into a well bore by using an attachment to the lubricator. Through the use of this frac ball dispenser attachment to a lubricator, time and additional cost of equipment is reduced. Additionally, the present invention enables the dispensing of frac balls into the well bore without having to set up an expensive and time-consuming fixed frac dispensing unit directly above the well bore.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An apparatus for deploying frac balls into a wellhead connection, the apparatus comprising:

a hollow main body;

an inner sleeve positioned and moveable within an interior of the main body; and a ball retention device for retaining a frac ball within an interior of the inner sleeve;

wherein the main body and the inner sleeve are vertically aligned;

wherein the main body is configured to be attached to a lubricator;

wherein the inner sleeve is configured to be pushed vertically upward upon the inner sleeve being placed upon an upper portion of a wellhead;

wherein the ball retention device is configured to release a retained frac ball held by the ball retention device upon the inner sleeve being pushed vertically upward through an interior of the main body by being positioned on the upper portion of the wellhead.

2. The apparatus for deploying frac balls according to claim 1 wherein the apparatus further comprises a fastening mechanism for attaching the apparatus to lubricator.

3. The apparatus for deploying frac balls according to claim 1 wherein the ball retention device includes a passageway leading to an interior of the inner sleeve for deployment of a frac ball.

4. The apparatus for deploying frac balls according to claim 3 wherein the ball retention device includes a moveable gate for retaining a frac ball in the apparatus.

5. The apparatus for deploying frac balls according to claim 1 wherein the inner sleeve is hollow.

6. The apparatus for deploying frac balls according to claim 1 further comprising a hopper affixed to a top portion of the apparatus for retaining a plurality of frac balls.

7. The apparatus for deploying frac balls according to claim 6 wherein the hopper includes a passageway allowing sequential delivery of frac balls to the ball retention device.

8. The apparatus for deploying frac balls according to claim 1 further comprising an indicator providing a visual indication when a frac ball is feed to the apparatus.

9. The apparatus for deploying frac balls according to claim 8 wherein the indicator is a flag which is raised and lower to provide a position of the frac ball within the apparatus.

10. The apparatus for deploying frac balls according to claim 1 further comprising an extension affixed to a bottom portion of the inner sleeve, the extension extending below the apparatus.

11. The apparatus for deploying frac balls according to claim 1 wherein:

the inner sleeve is an inner box; and the main body is an outer box.

12. A method of deploying frac balls into an open well bore, the method comprising the steps of:

affixing a frac ball dispenser to a lubricator;

wherein the frac ball dispenser has a vertically aligned hollow main body and a vertically aligned inner sleeve, the inner sleeve moveable within an interior of the main body;

wherein the inner sleeve is configured to be pushed vertically upward when the inner sleeve is placed upon an upper portion of a wellhead;

retaining a frac ball within the frac ball dispenser;

mechanically actuating a frac ball retaining device to release a frac ball retained in the frac ball dispenser; and wherein the step of mechanically actuating the frac ball device to release the frac ball includes positioning the inner sleeve on a top portion of the wellhead to push the inner sleeve upward to release the frac ball into the wellhead.

13. The method of deploying frac balls according to claim 12 wherein the step of mechanically actuating the frac ball retaining device to release the frac ball includes applying force to a lower side of the frac ball retaining device to release the frac ball.

* * * * *